US007525406B1

(12) United States Patent
Cheng

(10) Patent No.: US 7,525,406 B1
(45) Date of Patent: Apr. 28, 2009

(54) MULTIPLE COUPLING AND NON-COUPLING INDUCTOR

(75) Inventor: Chuan Tsai Cheng, Taipei (TW)

(73) Assignee: Well-Mag Electronic Ltd., Taipei (TW)

( * ) Notice: Subject to any disclaimer, the term of this patent is extended or adjusted under 35 U.S.C. 154(b) by 0 days.

(21) Appl. No.: 12/007,918

(22) Filed: Jan. 17, 2008

(51) Int. Cl.
*H01F 27/02* (2006.01)

(52) U.S. Cl. ..... 336/83; 336/232

(58) Field of Classification Search ..... 336/212, 336/223, 232, 233, 178, 192
See application file for complete search history.

(56) References Cited

U.S. PATENT DOCUMENTS 4,538,132 A * 8/1985 Hiyama et al. ..... 336/221
6,140,899 A * 10/2000 Kayser et al. ..... 335/220
7,397,336 B2 * 7/2008 Kawarai ..... 336/200

* cited by examiner

*Primary Examiner*—Lincoln Donovan
*Assistant Examiner*—Joselito Baisa
(74) *Attorney, Agent, or Firm*—Bacon & Thomas, PLLC

(57) ABSTRACT

The invention of the multiple coupling & non-coupling inductor includes at least an wrapped iron-core assembly and plural conductors where the wrapped iron-core assembly is composed of mutually corresponding magnetic conductors, which lie penetrated grooves on the X-axis & the Y-axis for penetration of plural conductors. Plural conductors provide mutual inductance along the X-axis and the Y-axis but none between the X-axis and the Y-axis to create a structural design of an iron-core assembly with a multiple coupling & non-coupling.

9 Claims, 5 Drawing Sheets

MULTIPLE COUPLING AND NON-COUPLING INDUCTOR

BACKGROUND OF THE INVENTION

I. Field of the Invention

The invention of the multiple coupling and non-coupling inductor is related to a design for reduction of power consumption due to current and abatement of electromagnetic interference, and employs penetrated grooves lying inside the X-axis as well as the Y-axis of magnetic conductors for penetration of every conductor as a structural design of the magnetic field of an iron-core assembly with multiple coupling and non-coupling.

II. Description of the Prior Art

According to the inventor's perennial research for a design of an iron-core structure, a resolution is amelioration of the old-type structure of an iron core, which employs both laminar conductor and magnetic core mutually stacking as a magnetic conductor with an adequate height for simple installation and reduction of electromagnetic interference to reach a securely connecting goal while the magnetic conductor is equipped on an electronic equipment.

Owing to a stacked combination of an iron-core magnetic object by a staggering configuration of two laminar conductors, which only offers a one-way double magnetic field in the said design, more magnetic fields are required and another iron-core components is prepared frequently for a product with a higher power output. Furthermore, to coincide with a tendency in the modern industry, the inventor is always pondering an integration of various functions and reduction in volume. Based on this perception, this invention employs mutually perpendicular penetrated grooves lying inside the magnetic conductor and makes one of conductors at least penetrate grooves that conductors generate mutual inductance along the X-axis and the Y-axis directions but none between the X-axis and the Y-axis to form an iron-core component with a structural design of multiple coupling & non-coupling magnetic field. Thus, the structural design with this single iron-core component is able to provide magnetic fields as offered by multiple iron-core components.

SUMMARY OF THE INVENTION

The major objective of this invention of the multiple coupling & non-coupling inductor is to offer a single iron-core component with a structural design of a multiple coupling & non-coupling iron core to solve a traditional configuration of two iron-core components and curtail space of embedding an iron-core component.

The secondary objective of this invention of the multiple coupling & non-coupling inductor is to provide an iron-core component, which is able to receive a signal corresponding to a different phase or a signal corresponding to an identical phase.

With an illustration of diagrams, the detailed description and technical content related to this invention is displayed as follows:

DETAILED DESCRIPTION OF THE PREFERRED EMBODIMENTS

Figure 1:
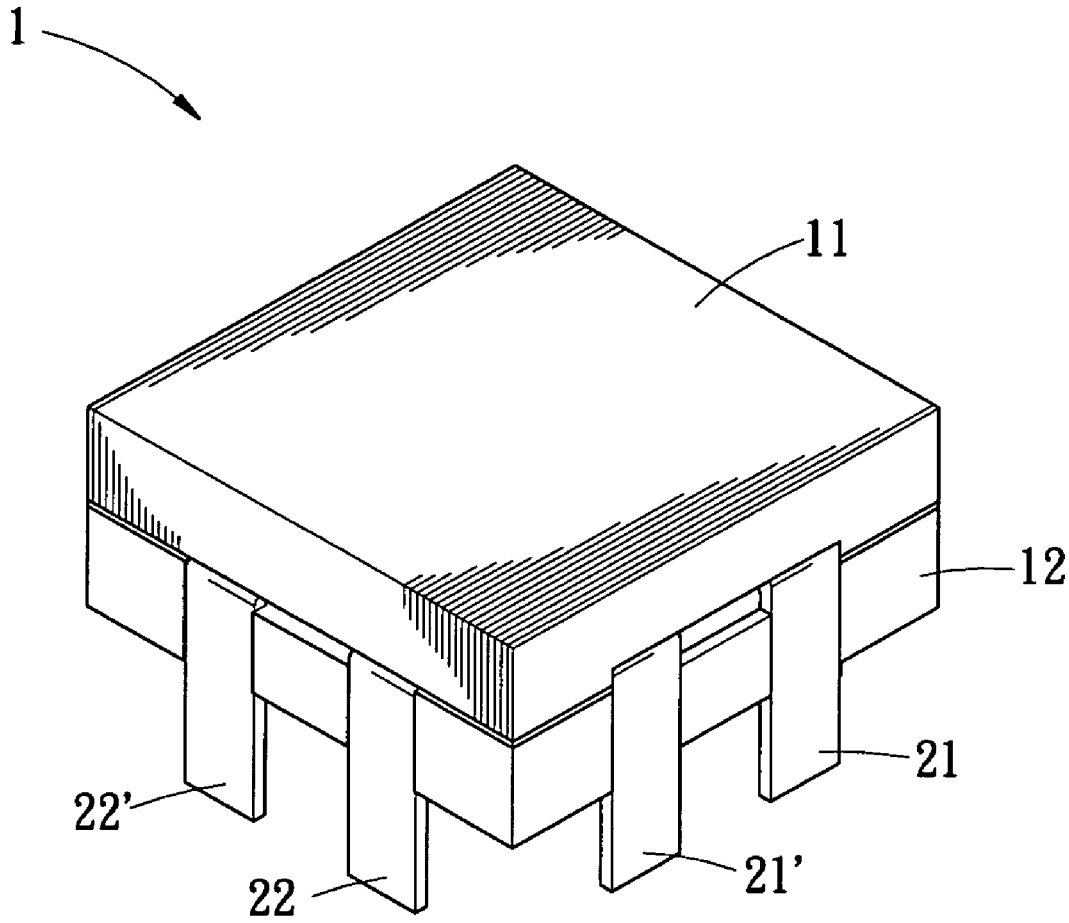
FIG. 1 is a three-dimensional assembly drawing for the inductor of this invention.
Figure 2:
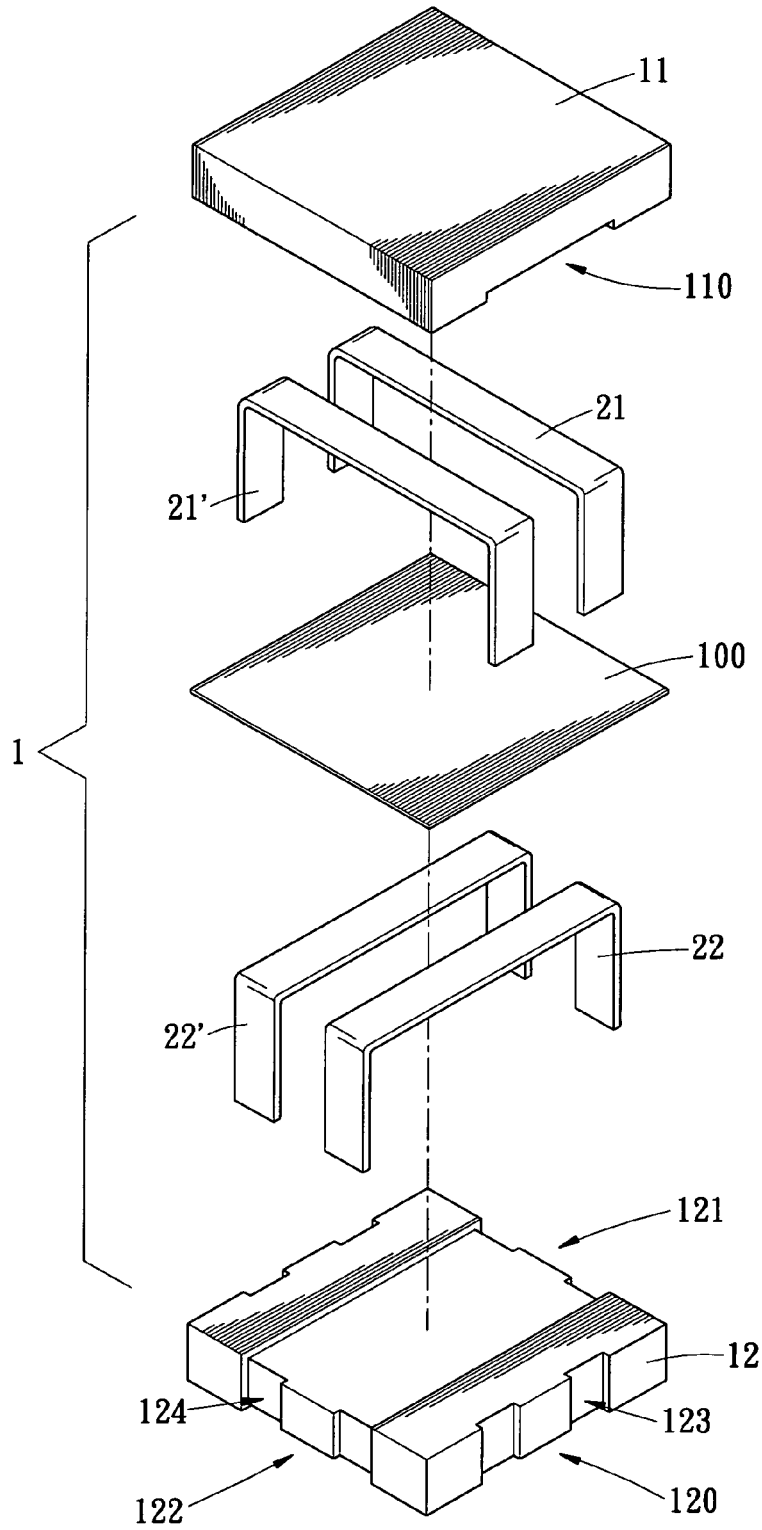
FIG. 2 is an exploded view for the inductor of this invention.
Figure 3A:
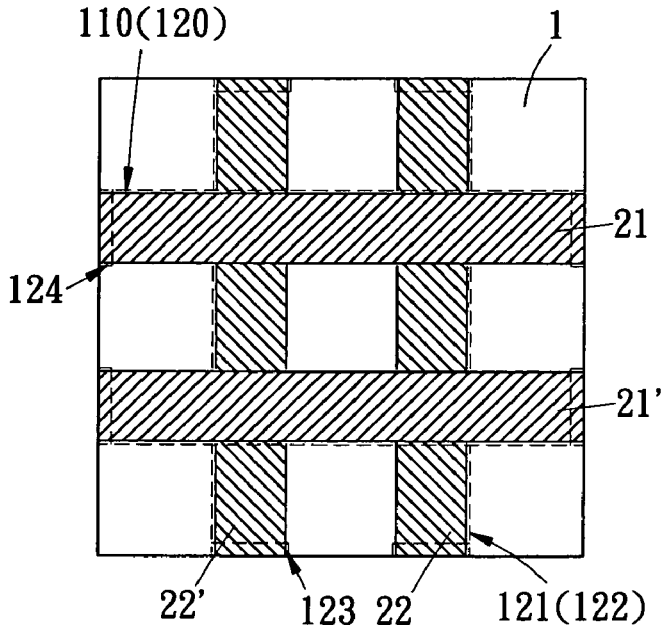
FIG. 3*a* is a vertical view from one side of the inductor of this invention.
Figure 3B:
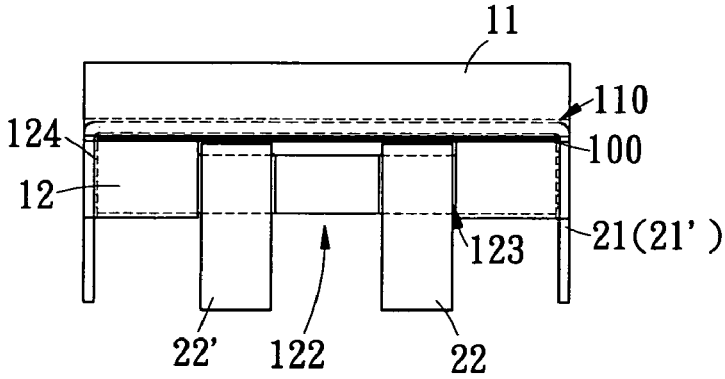
FIG. 3*b* is a lateral view for the inductor of this invention.
Figure 4A:
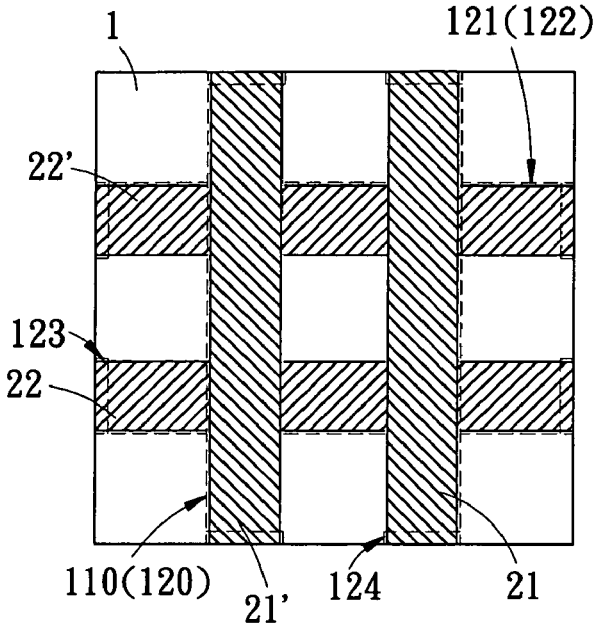
FIG. 4*a* is another vertical view from one side for the inductor of this invention.
Figure 4B:
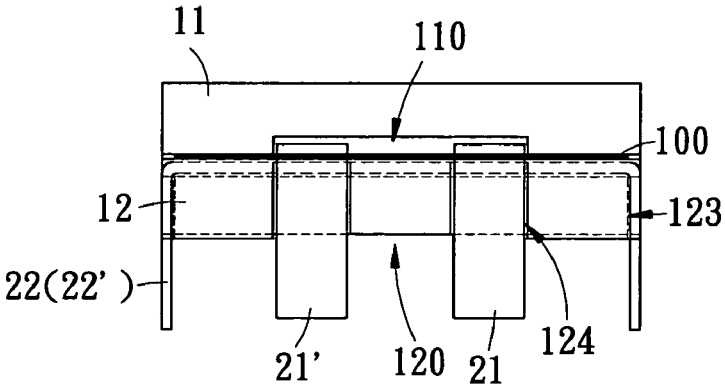
FIG. 4*b* is another lateral view of the inductor of this invention.

Firstly, referring to FIGS. 1 & 2, the invention of the multiple coupling & non-coupling inductor includes at least a wrapped iron-core assembly 1 and plural conductors 21, 21', 22, and 22' wherein the wrapped iron-core assembly 1 is composed of an upper magnetic conductor 11 and corresponding lower magnetic conductor 12, and for plural conductors 21, 21', 22, and 22', the X-axis conductors 21 & 21' are perpendicularly staggered with the Y-axis conductors 22 & 22' one another. Between the upper magnetic conductor 11 and the lower magnetic conductor 12, there is one insulated layer 100 as a separation where an X-axis upper channel 110 is prepared on the bottom of the upper magnetic conductor 11 as a penetrated track for penetration of conductors 21 & 21' along the X-axis, and a corresponding groove 123 and an X-axis lower channel 120 are prepared on the longitudinal sidewall and the bottom along the X-axis of lower magnetic conductor 12 for X-axis conductors 21 & 21', which can be fixed inside grooves and bended inwards for welding on the machine board;

Besides, the lower magnetic conductor 12 is similar to a serrate rectangle block where the Y-axis upper channel 121, which is perpendicular to the X-axis upper channel 110, is prepared on the top of the conductor as a penetrated track for the Y-axis conductors 22 & 22', and the same-directional corresponding groove 124 and the Y-axis lower channel 122 are prepared on the longitudinal sidewall and the bottom along the Y-axis of the lower magnetic conductor 12 for Y-axis conductors 22 & 22', which can be fixed inside grooves and bended inwards for welding on the machine board.

Moreover, also referring to FIGS. 3-1, 3-2, 4-1, and 4-2, the vertical view and lateral view of the invention of the multiple coupling & non-coupling inductor, it can be found that the wrapped iron-core assembly 1 is composed of an upper magnetic conductor 11 and a corresponding lower magnetic conductor 12, and an insulated layer 100 as a separation is prepared between the upper magnetic conductor 11 and the lower magnetic conductor 12. Inside the upper & lower conductors 11 and 12 lie channels 110 (120) and 121 (122) and grooves 123 & 124, which are mutually perpendicular channel and grooves, for penetration and fastening of X-axis conductors 21 & 21' and Y-axis conductors 22 & 22' inside grooves to generate mutual inductance between X-axis conductors 21 and 21' and between Y-axis conductors 22 and 22' but none between the X-axis & the Y-axis while current passes through them. Based on this design, the iron-core assembly own a structural design of multiple coupling & non-coupling.

Figure 5:
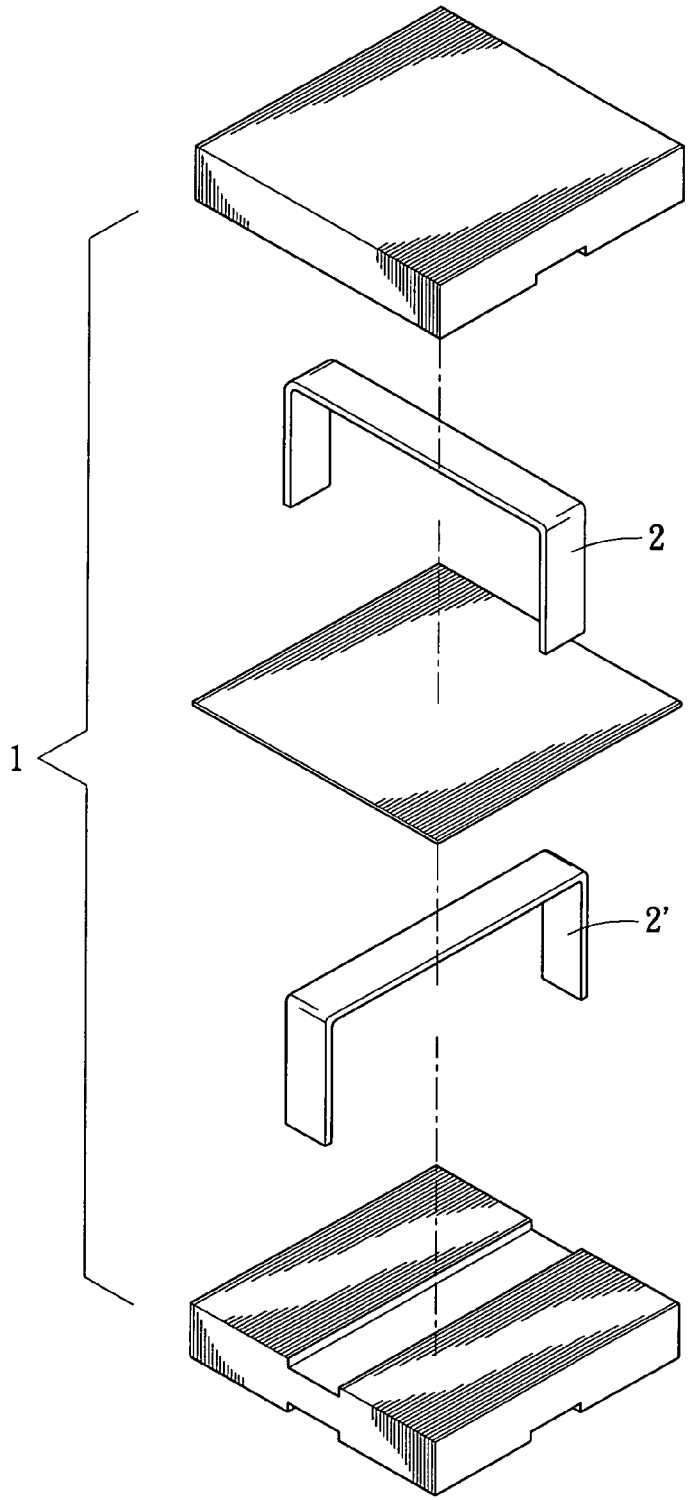
FIG. 5 is a three-dimensional exploded view for a known inductor.

As shown in FIG. 5, the known design employs two single conductors 2 and 2' as a conducting assembly where conductors are perpendicularly staggered each other as a combination of a wrapped iron-core assembly 1. However, the configuration only offers a one-way double magnetic field direction but there are more wrapped iron-core assemblies added into an electronic product to weaken & stabilize the magnetic field for any electronic product with a high output power, which produces its own magnetic field, or another magnetic field generated from the outside.

Thus, using several sets of mutually perpendicular penetrated channels and grooves contained inside magnetic conductors of this invention to include multiple sets of conductors with a stack method, the mutual inductance of plural conductors occurs along the X-axis and the Y-axis rather than between the X-axis and the Y-axis so an iron core has multiple multi-directional magnetic field from a single iron-core component providing a magnetic field for over one iron-core component.

What is claimed is:

1. A multiple coupling and non-coupling inductor including at least a wrapped iron-core assembly and plural conductors comprising:

the wrapped iron-core assembly includes an upper magnetic conductor and a corresponding lower magnetic conductor;

an X-axis upper channel on the bottom surface of the upper magnetic conductor;

at least a groove and X-axis lower channels on the bottom and longitudinal sidewalls of the lower magnetic conductor;

Y-axis upper and lower channels on the bottom and longitudinal sidewalls of the lower magnetic conductor;

an insulating layer between the upper and lower magnetic conductors;

the plural conductors include two sets of X-axis and Y-axis conductors which penetrate channels contained inside the wrapped iron-core assembly forming a vertical stack of plural conductors and extended exposed portions bent toward grooves on the longitudinal sidewall and the bottom of the wrapped iron-core assembly;

the plural conductors are vertically staggered to supply one or more mutual inductances along the X-axis and one or more mutual inductances along the Y-axis.

2. The multiple coupling and non-coupling inductor according to claim 1, wherein the bottom of the lower magnetic conductor of the wrapped iron-core assembly forms crisscross channels to cover plural X-axis and Y-axis bended conductors.

3. The multiple coupling and non-coupling inductor according to claim 1, wherein the top of the lower magnetic conductor of the wrapped iron-core assembly forms one slotted channel to contain plural Y-axis conductors.

4. The multiple coupling and non-coupling inductor according to claim 1, wherein the plural conductors are metal conductors.

5. The multiple coupling and non-coupling inductor according to claim 1, wherein the plural conductors supply one or more mutual inductances along the X-axis and one or more mutual inductances along the Y-axis but none between the X-axis and the Y-axis.

6. The multiple coupling and non-coupling inductor according to claim 1, wherein the plural conductors are perpendicularly staggered.

7. The multiple coupling and non-coupling inductor according to claim 1, wherein the lower magnetic conductor is a substantially serrate rectangular block.

8. The multiple coupling and non-coupling inductor according to claim 1, wherein the Y-axis upper channel is perpendicular to the X-axis upper chancel and the Y-axis upper channel is on the top surface of the lower magnetic conductor as a penetrated track of the Y-axis conductors.

9. The multiple coupling and non-coupling inductor according to claim 8, wherein a groove and Y-axis lower channel are on a longitudinal sidewall and bottom of the lower magnetic conductor to fix the Y-axis conductors inside of the grooves and bent inwards.

* * * * *